US005392520A

United States Patent [19]

Anderka

[11] Patent Number: 5,392,520

[45] Date of Patent: Feb. 28, 1995

[54] VECTOR BRUSH

[75] Inventor: Gerold Anderka, Ellerbek, Germany

[73] Assignee: Rotring International GmbH & Co. KG, Hamburg, Germany

[21] Appl. No.: 28,145

[22] Filed: Mar. 9, 1993

[30] Foreign Application Priority Data

Mar. 19, 1992 [EP] European Pat. Off. ..... 92104779

[51] Int. Cl.[6] ..... B43L 13/00; B05B 3/00

[52] U.S. Cl. ..... 33/18.2; 33/1 M; 118/37; 118/323

[58] Field of Search ..... 33/18.1, 18.2, 1 M; 118/323, 37, 663, 710

[56] References Cited

U.S. PATENT DOCUMENTS

| | | | |
|---|---|---|---|
| 4,458,626 | 7/1984 | Dessilani | 118/315 |
| 4,467,525 | 8/1984 | Logan et al. | 33/18.2 |
| 4,640,222 | 2/1987 | Gerber | 118/323 X |
| 4,683,836 | 8/1987 | West | 118/323 X |
| 4,854,205 | 8/1989 | Anderka | 83/529 |
| 4,864,966 | 9/1989 | Anderson et al. | 118/668 |
| 4,979,380 | 12/1990 | Robbins et al. | 118/323 X |

FOREIGN PATENT DOCUMENTS

| | | |
|---|---|---|
| 0229935 | 7/1987 | European Pat. Off. . |
| 0359846 | 3/1990 | European Pat. Off. . |
| 2515988 | 5/1983 | France . |
| 2619754 | 3/1989 | France . |

*Primary Examiner*—Alvin Wirthlin

*Attorney, Agent, or Firm*—Fitzpatrick, Cella, Harper & Scinto

[57] ABSTRACT

A vector brush can be attached to the front face of a movable carriage of a device for cutting foil material. The vector brush includes an air brush, which can be adjusted in height, thereby adjusting the size of its atomizing cone. The motion of the air brush is controlled by the motion of the carriage in one direction and the motion of the foil strip moved underneath it in the perpendicular direction. After a pattern has been sprayed on the foil material with the vector brush, it can immediately be cut out with a cutting tool mounted on the same carriage.

19 Claims, 4 Drawing Sheets

VECTOR BRUSH

BACKGROUND OF THE INVENTION

1. Field of Invention

The present invention relates to a vector brush for drawing on and cutting a foil material.

2. Brief Description of the Prior Art

A cutting device for foils is already known from U.S. Pat. No. 4,854,205, whereby letters, characters or the like can be cut from a two-ply foil in order to produce signs, and masks for painting and spray painting, lettering, etc. For this purpose the known cutting device has a housing with two cheeks disposed at a distance from each other, between which the foil sheet is guided by tractors. A carriage that supports the cutting tool is mounted on guide rods extending between the cheeks. The carriage is moved perpendicularly across the sheet in a Y-direction. The motion of the foil sheet in the X-direction is effected by the tractors, which can move the sheet in a controlled manner not only forward, but also backward.

A similar cutting device is known from U.S. Pat. No. 4,467,525, where the cutting device can also be replaced by a writing tool. With this known device, the carriage is also controlled electronically by a control device. With this known device, however, it is only possible either to cut or draw.

In addition to ink writing instruments and drawing pens, a so-called air brush is already known as a drawing instrument, wherein a fine cone of atomized ink can be applied to a substrate in a metered manner. The supply of ink is effected through a central conduit in which a needle is seated that enlarges or reduces the cross-section of the emission opening, thereby regulating the flow of ink. The emission opening is surrounded by an air conduit, through which compressed air is supplied at a pressure of approximately 0.5 to 2.5 bar. The compressed air aspirates the ink from the emission opening and forms a fine atomizing cone. The diameter of the atomizing cone sprayed onto a substrate is a function of the distance of the emission opening above the substrate. The ink atomizing cone is adjusted over a relatively wide range by means of a suitable selection of this distance from the substrate, and by an adjustment of the needle in the emission opening.

A disadvantage of such known air brushes is that, up to now, such brushes could not be computer-controlled.

A disadvantage of such known cutting devices is that they can only either cut or draw. Air brushes were not used in the drawing industry up to now, because the required ink and air connections could not easily be installed in the carriages of a writing tool, as would be conventional with an ink writing instrument.

OBJECT AND SUMMARY OF THE INVENTION

The primary object of the invention, therefore, is to create a device with which a foil can be written upon with an air brush and subsequently cut out in a controlled manner during one operation.

According to the invention, it is possible, in a surprisingly simple way, to spray letters on a sheet with a computer-controlled air brush and, immediately afterward, cut out the letters or characters which have been sprayed on. Further, astonishing effects can be obtained by means of computer-controlling the air brush, for example, whereby cut-out letters can be made to appear three-dimensional. Such a device according to the present invention is called a "vector brush."

A further advantage of the invention is a vector brush that can be exchanged quickly and easily if an interruption occurs, or if a new color is desired.

The ink reservoir, advantageously, also can be exchanged alone or along with the air brush.

Further features of this invention are explained below, wherein reference is made to the accompanying drawings.

DETAILED DESCRIPTION OF THE PREFERRED EMBODIMENTS

Figure 1:
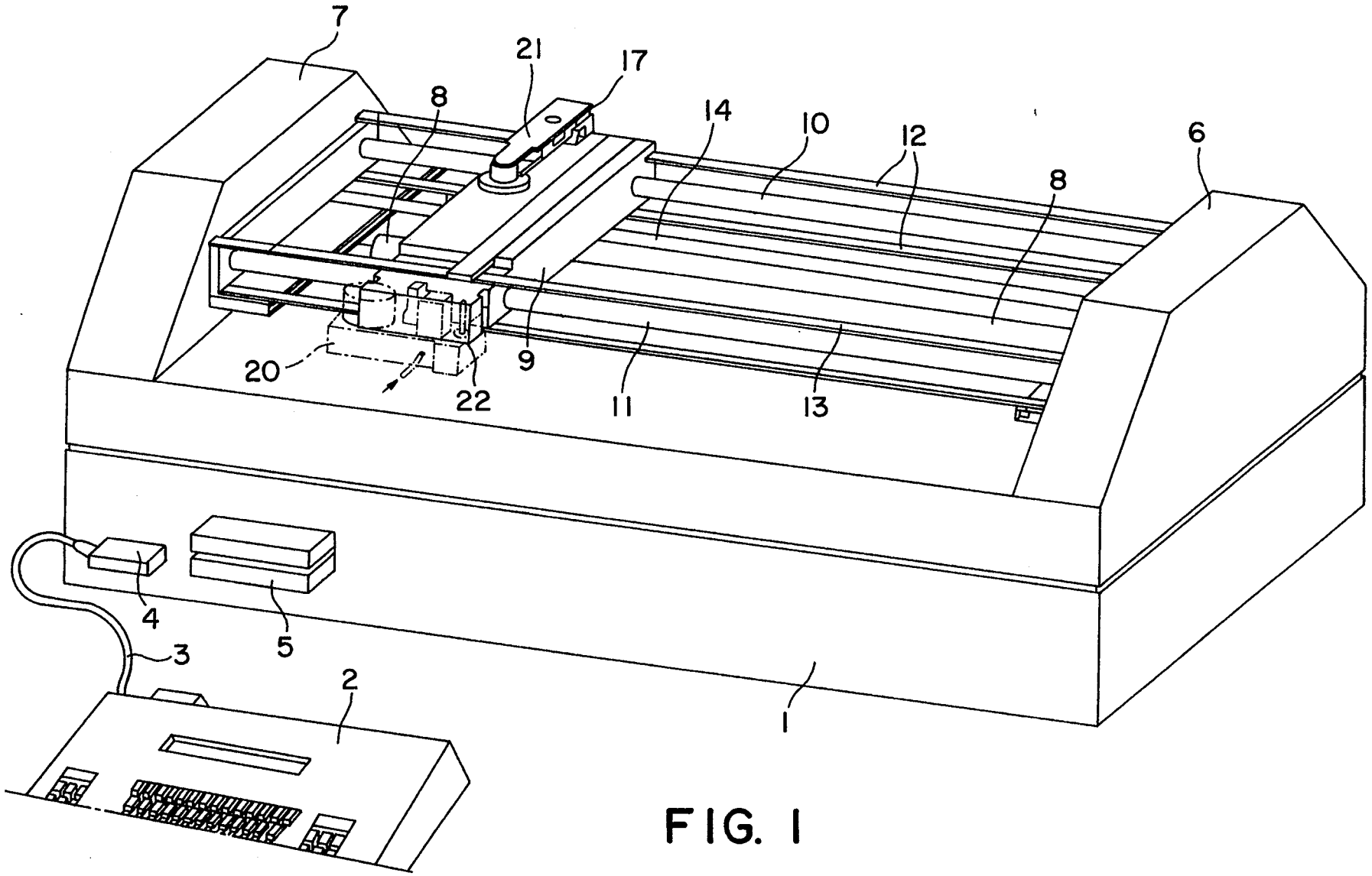
FIG. 1 is a perspective view of an embodiment of the invention, with the vector brush shown in dot-dash lines.

The plotting system represented in FIG. 1 is similar in its basic design to the cutting device illustrated in U.S. Pat. No. 4,854,205, which is incorporated herein by reference for further details about control mechanisms and entry of control commands or the like.

As shown in FIG. 1, a housing i is provided that has two lateral cheeks and 7, between which are located guide rods 10 and 11 for a carriage 9 that is mowable along these guide rods. Endless toothed belts 12, 13 are fastened to the carriage 9 and operate in a conventional way which is not illustrated to move the carriage 9 back and forth in a controlled manner along the guide rods 10, 11.

The motion of the carriage 9 is controlled by commands entered into the control unit of the device (not shown) via a keyboard 2, which is connected to the cutting device by means of a cable 3 and a plug 4. The control unit is additionally connected to program cassettes 5, which are exchangeable and with which different typefaces and symbols can, for example, be produced. Such a control unit also can, for example, correspond to the control illustrated in U.S. Pat. No. 4,467,525, incorporated herein by reference. Alternatively, in place of program cassettes 5, a computer can be attached with a monitor used to control commands.

Below the carriage 9 is a support roller 8, by means of which a strip of material to be cut, usually a two-ply plastic foil, is guided in the same fashion as shown in U.S. Pat. No. 4,467,525, for example. During the writing process, a back-and-forth motion of the strip is effected by tractors (not shown) in one coordinate (the X direction) of the cutting path, and the support roller 8 executes a corresponding rotational movement (the Y direction) around its longitudinal axis.

A cutting tool seated in a guide holder (not shown), is movable back and forth in the direction of the longitudinal axis of the guide holder and also is rotatable, so that the cutting element provided on its front end is movable between a raised position and a lowered or working position. In the working position the cutting element is in cutting engagement with the foil material on the support roller 8. Further details of such a cutting tool are provided by U.S. Pat. No. 4,854,205.

Also attached to the carriage 9 is a pivotable, one-armed lever 17 that bears the cutting tool on its free end. A leaf spring 21 presses the cutting tool (not shown), against the foil material to be cut. An eccentric shaft 14 serves to raise or lower the cutting tool. The eccentric shaft 14 is controlled conventionally by means of a step motor (not shown).

Figure 2:
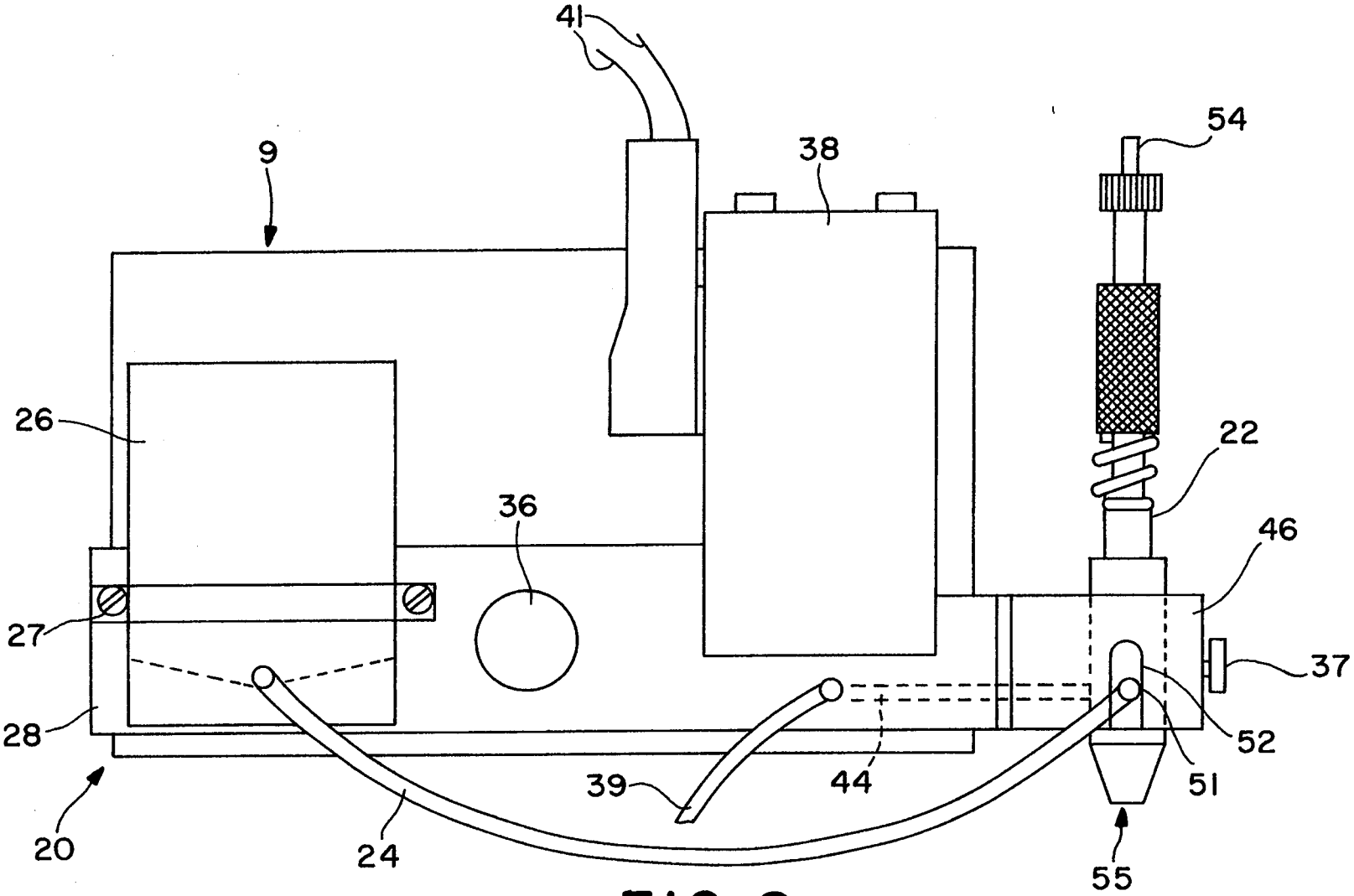
FIG. 2 is a schematic view of the vector brush of FIG. 1.
Figure 3:
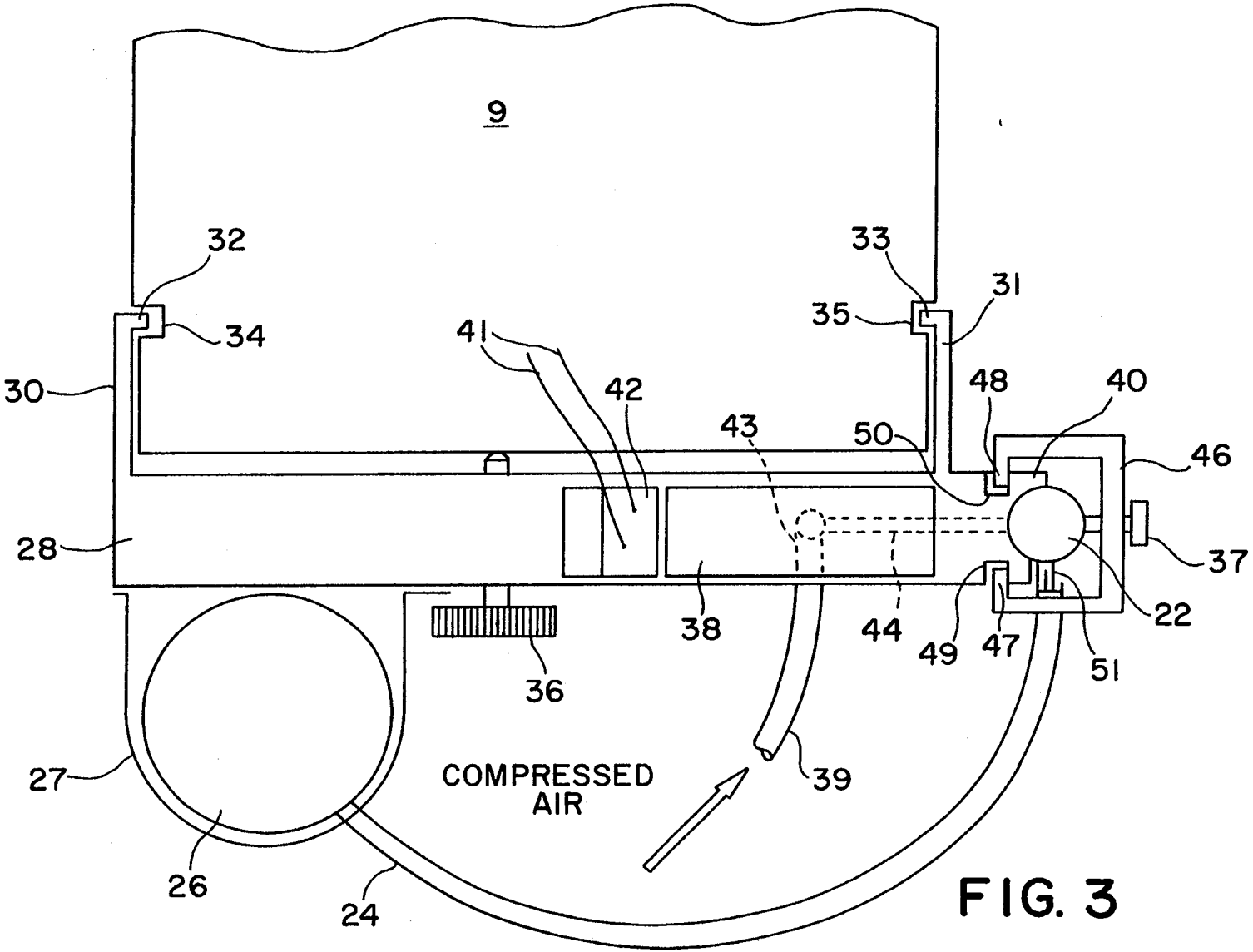
FIG. 3 is a schematic top view of the vector brush of FIG. 2.

FIGS. 2 and 3 are schematic views of a vector brush 20 attached to the face end of the carriage 9 in FIG. 1. The vector brush 20 has an air brush 22 that is in flow connection with an ink reservoir 26, via a hose 24. The ink reservoir 26 is fastened with the aid of a strap 27 to a cover 28 that extends laterally around the carriage 9 with two arms 30 and 31 (FIG. 3) and engages vertical guide grooves 34 and 35 of the carriage 9 with catches 32 and 33 provided at the ends of the arms 30 and 31. A first clamping screw 36 is screwed through the cover 28 and has a point that presses against the face end of carriage 9. Thus, the cover 28 is clamped tightly against the carriage.

Also on the cover 28 is a solenoid valve 38 that controls a supply of compressed air, which is conveyed to the air brush 22 via a hose 39 in the direction shown by the arrow at a pressure of approximately 0.5 to 2.3 bar. The construction of solenoid valve 38 is conventional and a voltage is supplied via supply line 41, which leads to a connector 42 that is fastened laterally to the solenoid valve 38. Such solenoid valves are available from the firm FESTO under the ID number 30 217 MZH-3-04. The valve controls a first conduit 43, having a free end connected to the hose 39. The first conduit 43 makes a transition to a second conduit 44, which is connected to the air brush 22, via an air connector of the airbrush (not shown). The valve cone of the solenoid valve 38 is seated at the interface of the first conduit 43 to the second conduit 44.

The air brush 22 rests in a semicircular recess of a lateral cover extension 40, to which it is securely attached by means of a strap 46 with the aid of a second clamping screw 37. The strap 46 can be most distinctly recognized in the top view of FIG. 3, and it has the shape of a U-section with leg ends 47 and 48 extending inwardly and engaging vertical guide grooves 49 and 50 of the cover extension 40. In addition, as shown in FIG. 2, a wall of the strap 46 is provided with a section 52 that opens downward, so that the strap 46 can be placed either over ink connector 51 or ink hose 24.

It should be noted that the air connector of the air brush 22 can be inserted by means of small seals, such as O-rings, into the second conduit 44 in order to produce the compressed air connection. The type of seal between ink hose 24 and ink connector 51 is not critical, because the ink is supplied at low pressure. It is sufficient that the ink hose 24 fits well or tightly over the ink connector 51 when attached to the air brush 22.

The embodiment shown in FIGS. 2 and 3 is intended to show schematically the arrangement and assignment of the individual elements of the vector brush 20. Also recognizable in FIG. 2 is a needle 54 on the air brush that serves to adjust the cross-section of the opening of an air brush nozzle 55.

Figure 4:
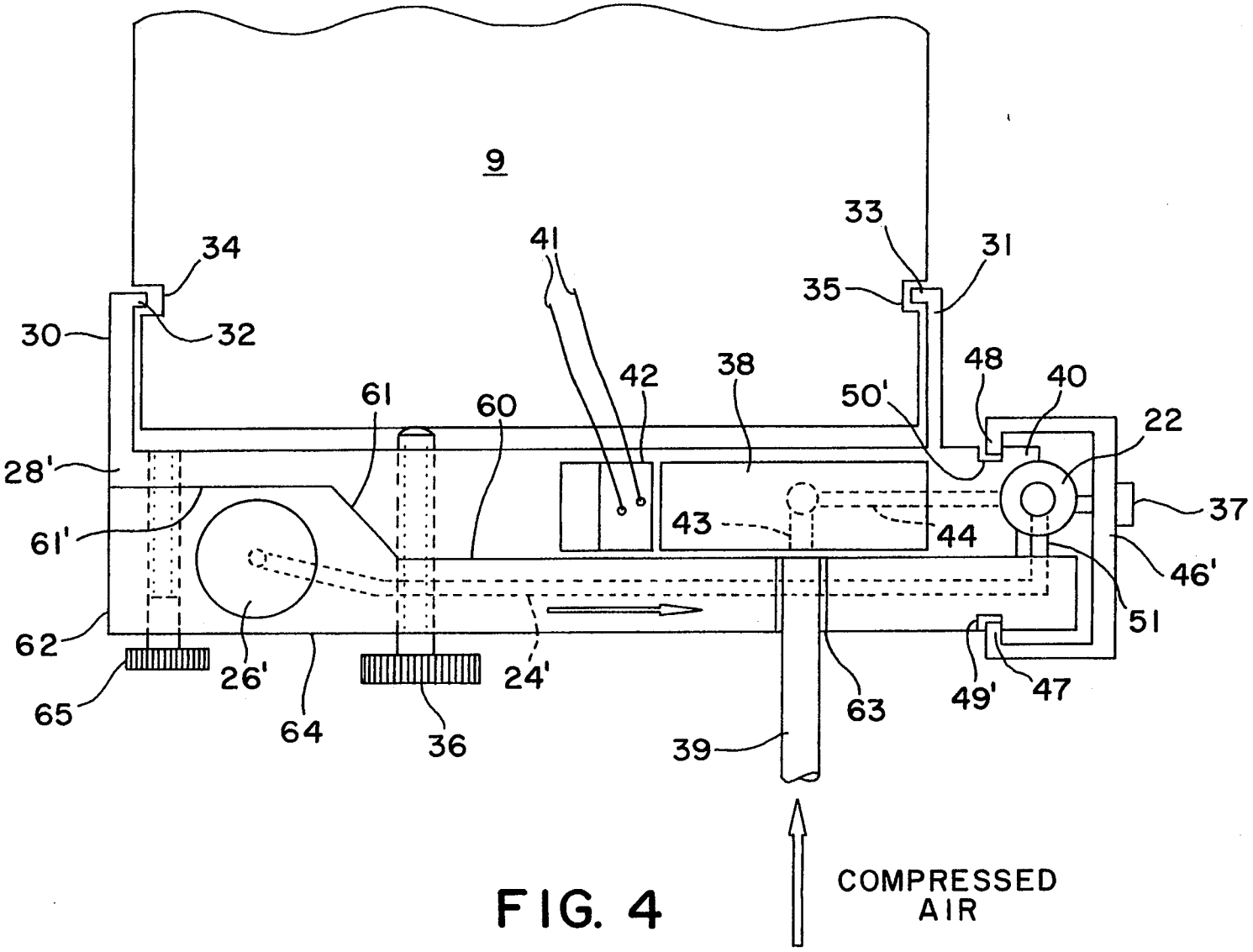
FIG. 4 is a schematic top view of another embodiment of the vector brush.

FIG. 4 shows a second embodiment in which the ink reservoir 26' is integrated into a cassette 62. In this figure, all elements that correspond to elements in other figures are indicated with the same reference numerals.

Arms 30 and 31 of cover 28' extend laterally around the carriage 9 so as to engage catches 32 and 33 in the guide grooves 34 and 35 provided in the carriage 9. The guide grooves 34, and 35 run in a vertical direction so that the cover 28' can be adjusted in height by loosening a first clamping screw 36. The first clamping screw 36 thereafter is re-tightened. The cover 28' also supports the solenoid valve 38, which controls the connection between the first conduit 43 and the second conduit 44. A compressed air hose 39 with the direction of air flow indicated by the arrow is attached to the first conduit 43, as in the foregoing embodiment, simply by inserting the first conduit into a connector. The air brush 22 is once again connected to the second conduit 44 by means of a connector provided at the air brush on which sealing rings, preferably O-rings, are mounted. The connector 42 for voltage supply 41 is attached laterally to the magnet valve 38.

The cover 28' differs from the cover 2.8 of FIGS. 2 and 3 in the design of its front face 60, in particular, which has a step 61. Also, the cover extension 40 is only provided on one side with a vertical groove 50'. The other side is smooth. The cassette 62 rests on the front face 60 of the cover 28' which has a rear wall 61 that is shaped complementary to the face end 60. The front wall 64 of the cassette 62 is level or planar except for a vertical groove 49', which serves in the engagement of the leg end 47 of the strap 46'. The other leg end 48 engages the vertical groove 50'. The second clamping screw 37 again acts to secure the strap 46'.

The strap 46' essentially differs from the strap 46 of FIG. 2 or 3 in that slot 52, which opens downward for accepting or leading the ink hose 24 through, is not necessary. In place of ink hose 24, an ink conduit 24', that leads from an ink cartridge 26' to the ink connector 51 of the air brush 22, is integrated into the cassette 62. In this embodiment, a sealing ring is likewise mounted on the ink connector 51 of the air brush 22 to seal the ink conduit 24'. Finally, it is also significant that the cassette 62 is provided, with a slot 63, in the area of the compressed air hose 39, that opens upward to permit assembly on, or attachment to, the cover 28'. A third clamping screw 65 is inserted through the cassette 62, near the ink reservoir 26' and screwed into the cover 28' to secure the cassette 62 to the cover 28'.

Assembly of the cassette 62 is executed as follows.

First, the compressed air hose 39 is placed on the connector at the first conduit 43. Then O-rings are mounted on the two connectors of the air brush 22 and the air connector (not shown) is inserted into the second conduit 44, so that the air brush fits closely against the semicircular recess of the cover extension 40. Then the cassette 62 is pressed against the face end 61 of the cover 28', so that the ink connector 51 of the air brush 22 protrudes into the ink conduit 24'. The leg ends 47 and 48 of the strap 46' then are pushed from above and into the guide grooves 49' and 50' until a correct positioning is attained. In this position the second clamping screw 37 is screwed down. The cassette 62 subsequently is secured to the cover 28' with the third clamping screw 65. The vector brush 20 assembled in this way can now be pushed from above into the guide grooves 34 and 35 of the carriage 9 and secured with the first clamping screw 36 at the desired height. By means of this screw 36, the distance from the air brush nozzle 55 to the foil strip to be written upon is adjusted to produce a larger or smaller atomizing cone. The vector brush 20 is now ready for service.

The ink cartridge 26' is secured in the cassette 62 in the conventional fashion. For example, in a manner common with ink writing instruments, the ink cartridge 26' is pierced automatically by a pin and thereby opened when it is inserted.

The foregoing description of preferred embodiments is not intended to limit the scope of the invention. Those skilled in the art will understand from the disclosure that other variants and embodiments, within the spirit and scope of the invention, are possible. Therefore, the scope of the invention is to be limited solely by the appended claims.

I claim:

1. An apparatus for both drawing upon and cutting a foil material, comprising:

transport means for transporting the foil material along a first axis;

carriage means, movable along a second axis perpendicular to said first axis;

vector brush means, attached to said carriage means, which comprises an air brush and a means for cutting the foil material; and control means for controlling the motion of said carriage means, the motion of said foil transport means, a drawing by said vector brush means upon the foil material, and a cutting of the foil material by said means for cutting.

2. The apparatus of claim 1, wherein said vector brush means further comprises a solenoid valve, and said control means selectively controls a supply of compressed air to said air brush, and an ink reservoir, which supplies ink to said air brush.

3. The apparatus of claim 2, wherein said vector brush means further comprises a cover, said cover being fastened to said carriage means, wherein said air brush, said solenoid valve, and said ink reservoir are mounted on said cover.

4. The apparatus of claim 3, wherein said carriage means comprises guide means, and wherein said cover is inserted into said guide means.

5. The apparatus of claim 4, wherein said guide means comprises .vertical guide grooves provided in opposite lateral surfaces of said carriage means.

6. The apparatus of claim 3, wherein said vector brush means further comprises a first clamping screw, and, wherein said cover is fastened to said carriage means by means of said first clamping screw.

7. The apparatus of claim 3, wherein said vector brush means further comprises a strap and a clamping device, and wherein said air brush is fastened to said cover by means of said strap and said clamping device.

8. The apparatus of claim 5, wherein said vector brush means further comprises an ink hose, and wherein said strap has a portion that opens downward, through which said ink hose extends to connect said air brush to said ink reservoir.

9. The apparatus of either claims 5 or 8, wherein said cover has two vertical guide grooves, wherein said strap comprises two leg ends, and wherein said strap is substantially U-shaped and extends around said cover, each of said leg ends engaging a respective one of said vertical guide grooves in said cover.

10. The apparatus of claim 3, wherein said vector brush means further comprises a cassette that is fastened to said cover, wherein said ink reservoir is disposed in said cassette, and wherein said cassette comprises an ink conduit in flow connection with said ink reservoir.

11. The apparatus of claim 10, wherein said air brush comprises a connector, and wherein said ink conduit is in flow connection with said connector.

12. The apparatus of claim 11, wherein said cassette has a slot or bore through which a compressed air hose can be received.

13. The apparatus of any of claims 10 through 12, wherein a vertical guide groove is disposed in a side wall of said cover, and another vertical guide groove is disposed in a front wall of said cassette.

14. The apparatus of claim 2, wherein said vector brush means further comprises a connector for electric lines which interconnects said control means and said solenoid valve.

15. An apparatus for drawing upon and then subsequently cutting a foil material, comprising:

a housing comprising a pair of guide rods;

carriage means, movable along said guide rods;

vector brush means for drawing upon the foil material mounted on said carriage means, and comprising an air brush, ink supply means for supplying ink to said air brush, air supply means for supplying compressed air to said air brush, and means for cutting the foil material;

transport means for transporting the foil material along an axis perpendicular to said guide rods; and control means for controlling said carriage means, said transport means, a drawing by said vector brush means upon the foil material, and a cutting of the foil material by said cutting means.

16. The apparatus of claim 15, wherein said vector brush means further comprises a cover, said cover being fastened to said carriage means, wherein said air brush, said ink supply means, and said air supply means are mounted on said cover.

17. The apparatus of claim 16, wherein said vector brush means further comprises a cassette that is fastened to said cover, wherein said ink supply means is disposed in said cassette, and wherein said cassette comprises an ink conduit, in flow connection between said ink supply means and a connector of said air brush.

18. The apparatus of claim 16, wherein said vector brush means further comprises an ink conduit in flow connection between said ink supply means and a connector of said air brush.

19. The apparatus of claim 15 wherein said control means comprises a central processing unit.

* * * * *